US005579917A

United States Patent [19]

Lofgren et al.

[11] Patent Number: 5,579,917

[45] Date of Patent: Dec. 3, 1996

[54] SUSPENSION PACKAGE

[75] Inventors: Lewis C. Lofgren, Chicago; Noel M. Phillips, River Forest, both of Ill.

[73] Assignee: ADE, Inc., Chicago, Ill.

[21] Appl. No.: 441,797

[22] Filed: May 16, 1995

[51] Int. Cl.[6] ..... B65D 81/02

[52] U.S. Cl. ..... 206/583

[58] Field of Search ..... 206/583, 521

[56] References Cited

U.S. PATENT DOCUMENTS

| | | | |
|---|---|---|---|
| 1,185,709 | 6/1916 | Penn . | |
| 2,501,570 | 3/1950 | Larsen . | |
| 2,596,244 | 5/1952 | Jacket . | |
| 2,681,142 | 6/1954 | Cohen . | |
| 2,700,460 | 1/1955 | Hoover . | |
| 2,700,518 | 1/1955 | Ryno et al. . | |
| 2,735,543 | 2/1956 | Trow . | |
| 2,771,184 | 11/1956 | Ryno et al. . | |
| 2,785,795 | 3/1957 | Ryno et al. . | |
| 2,811,246 | 10/1957 | Sloane . | |
| 2,837,208 | 6/1958 | Lingenfelter . | |
| 2,956,672 | 10/1960 | Kirkpatrick . | |
| 3,136,413 | 6/1964 | Hall . | |
| 3,463,309 | 8/1969 | Szostek . | |
| 3,521,743 | 7/1970 | Sposito . | |
| 3,552,595 | 1/1971 | Gerner . | |
| 3,692,264 | 9/1972 | Burkhard et al. . | |
| 3,752,301 | 8/1973 | Bluemel . | |
| 3,853,220 | 12/1974 | Luray . | |
| 3,857,487 | 12/1974 | Misslin . | |
| 3,876,812 | 4/1975 | Peters . | |
| 4,027,794 | 6/1977 | Olson | 206/583 X |
| 4,319,684 | 3/1982 | Backman et al. . | |
| 4,606,459 | 8/1986 | Luray . | |
| 4,606,460 | 8/1986 | Luray . | |
| 5,056,665 | 10/1991 | Boecker et al. . | |
| 5,226,542 | 7/1993 | Boecker et al. . | |

FOREIGN PATENT DOCUMENTS

| | | |
|---|---|---|
| 0221604 | 5/1987 | European Pat. Off. . |
| 2723-175 | 11/1978 | Germany . |
| 53-135796 | 11/1978 | Japan . |
| 427638 | 6/1967 | Switzerland . |
| 827346 | 1/1979 | U.S.S.R. . |
| 237322 | 7/1925 | United Kingdom . |
| WO8302932 | 9/1983 | WIPO . |

*Primary Examiner*—Bryon P. Gehman

*Attorney, Agent, or Firm*—Brinks Hofer Gilson & Lione

[57] ABSTRACT

A suspension package includes a frame and a hammock. The hammock is tensioned by tensioning panels at each end of the frame. The lower edges of the frame include bottom panels that are secured together at two opposing corners such that the bottom panels automatically move to a side wall bracing position when the frame is squared. The tensioning panel 42 is sufficiently long to overlap each of the side walls in order to apply a substantial portion of loads from the hammock directly to the side walls and thereby reduce creasing at the end walls. The hammock is C-shaped in cross section and includes welded product-retention regions between the upper and lower portions of the hammock to prevent the product from sliding into contact with the end walls. Accessories are held in the hammock by a tubular accessory holder which is held in place on an end wall of the frame by an outer box. The suspension package is moved into and out of the outer box along a direction perpendicular to one of the sides of the frame.

36 Claims, 8 Drawing Sheets

4
4
74
16
22
66
78
12
20
4
P
72
16
10
14
20
74
40
42
60
4
2
14
22
2
54
9
18
46
50
94
44
9
62
92b
94
92a
94
94
90
92a
92b

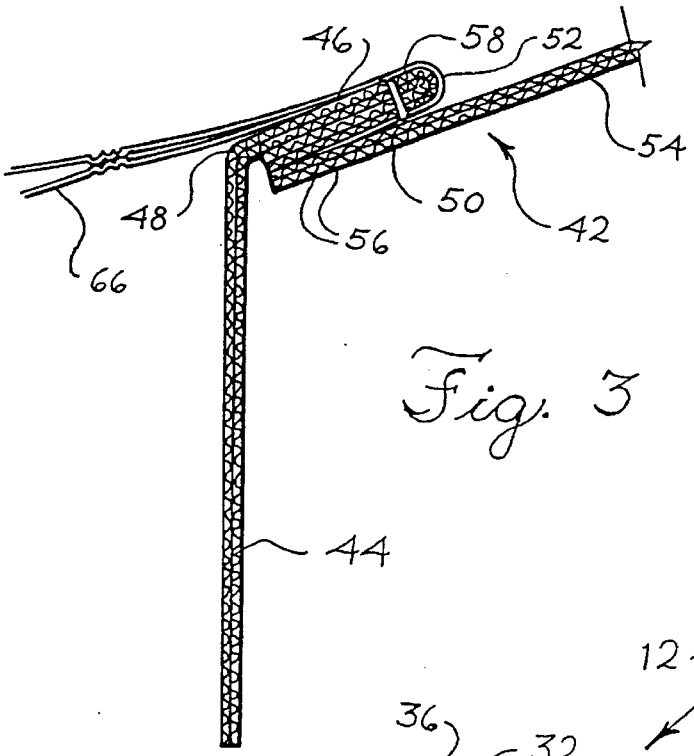
Fig. 3
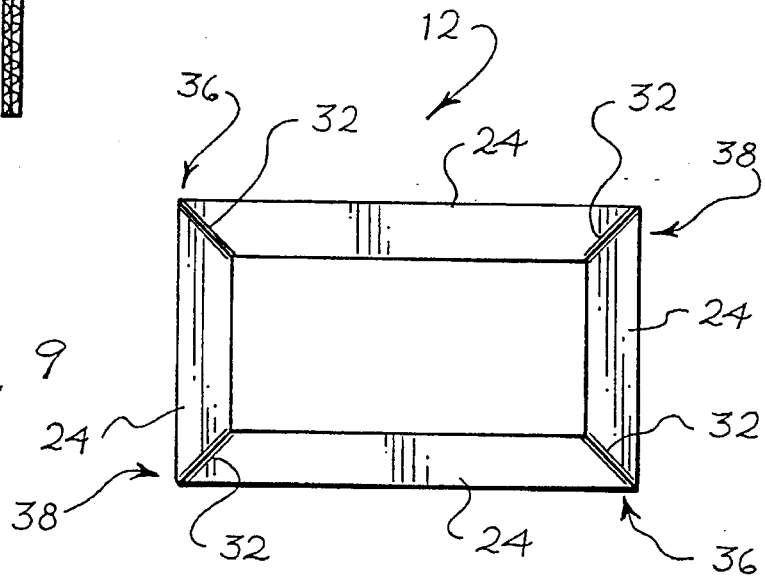
Fig. 9
Fig. 8
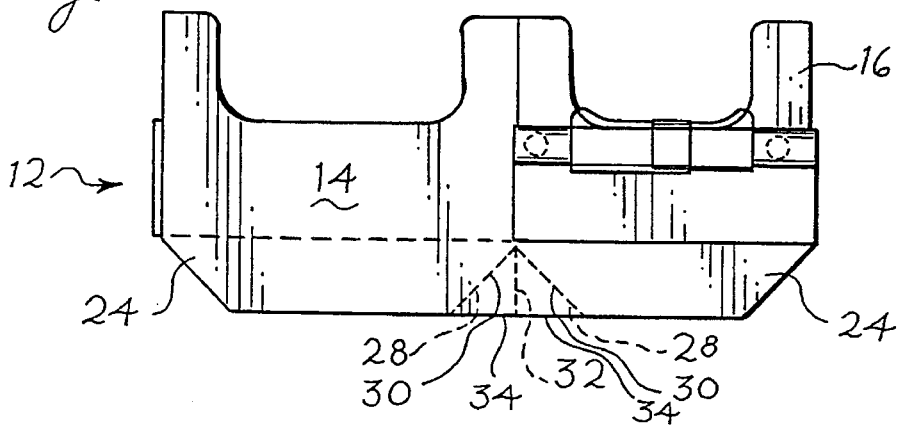

SUSPENSION PACKAGE

BACKGROUND OF THE INVENTION

This invention relates to an improved suspension package for protecting a product against shipping damage.

Luray U.S. Pat. No. 4,606,459 and Boecker U.S. Pat. No. 5,226,542 disclose suspension packages utilizing a hammock that is stretched across the ends of a frame to suspend a product away from the frame during shipment. In these packages the hammock is tensioned by means of tensor flaps that are pivotably mounted to the end walls.

The suspension package shown in U.S. Pat. No. 5,226,542 has been successful in protecting lightweight products from shipping damage. One particular feature of this design is that the frame can be collapsed to a relatively small volume when not in use. This is an important advantage as compared with other packaging materials such as foam, which maintain the same cubic dimensions whether loaded or stored.

Heavier products, as for example products in the range of 5 to 15 pounds, impose greater stress on the frame. In particular, a relatively heavy product undergoing a large acceleration in a direction parallel to the hammock imposes large buckling forces on the end walls of the frame. In the event the end walls buckle or crease, the hammock loses tension and the product can easily be damaged by contact with one of the walls of the frame. Also, heavier products tend to slide in the hammock, even when it is properly tensioned. Finally, the bottom braces, designed to reinforce the end walls, may be considered too complicated by some users, in that they require some degree of assembly when the frame is moved from the collapsed to the operational position.

The present invention is directed to an improved suspension package that to a great extent overcomes the disadvantages discussed above.

SUMMARY OF THE INVENTION

This invention relates to improvements to a suspension package of the type having a frame comprising two side walls interconnected by two end walls, at least one tensioning panel pivotably mounted to one of the end walls, and a product-retaining hammock mounted to the frame to suspend a product in the frame between the end walls. The hammock is secured to the tensioning panel such that pivotal movement of the tensioning panel in a selected direction applies tension to the hammock, thereby suspending the product in the frame.

According to a first aspect of this invention, a suspension package of this type is provided with four bottom panels, each secured to a respective one of the walls. These bottom panels contact one another at four corners of the frame when the frame is in an operational position. At least two diametrically opposed first ones of the corners are expandable to allow the frame to collapse to a storage position in which the side walls approach one another.

According to a second aspect of this invention, a suspension package of the type described above is provided with a bridging element included in the tensioning panel. This bridging element has a length sufficient to extend across the end wall to or beyond the corners of the frame. The bridging element is positioned to receive forces from the hammock and to be supported on the side walls of the frame. Because the hammock transmits forces to the bridging element and the bridging element transmits these forces to the side walls, end wall buckling is reduced. The bridging element may include a panel oriented adjacent to and extending outwardly from the end wall, alongside the hammock.

According to a third aspect of this invention, a suspension package of the type described above is provided with a hammock comprising a lower portion and at least two upper portions. The upper portions define a product inserting and removing region therebetween. The upper and lower portions comprise product-retention regions between the product inserting and removing region and the end walls, and the upper and lower portions are secured together at the product-retention regions. In this way, the product-retention regions restrict a product suspended in the hammock from sliding along the hammock into contact with the end walls.

According to a fourth aspect of this invention, a suspension package of the type described above is provided with an extension panel included in the tensioning panel. This extension panel is dimensioned to extend under the frame, transverse to the end wall, when the hammock is tensioned. This extension panel resists any tendency of the tensioning panel to move outwardly in an uncontrolled fashion when the suspension package is in use.

According to a fifth aspect of this invention, a suspension package of the type described above is provided with a frame-enclosing outer box. This box comprises a plurality of fixed panels and one or more openable flaps. The flaps operate to open and close a side of the box. This openable side corresponds in shape to a first one of the walls of the frame such that the frame is moved into and out of the box along an axis of movement perpendicular to the first wall. The box is dimensioned to hold the tensioning panel in a hammock-tensioning position when the frame is positioned in the box.

According to a sixth aspect of this invention, a suspension package of the type described above is provided with an accessory holder held in place on at least one of the walls of the frame. This accessory holder comprises a tube which comprises at least one slot. This slot receives at least one wall to hold the tube and any accessories contained in the tube on the frame.

These six aspects of the invention are preferably used together as described below. However, it should be understood that in some applications it may be preferable to use one, two, or more of these improvements separately.

BRIEF DESCRIPTION OF THE DRAWINGS

FIG. 3 is a view corresponding to FIG. 2 showing the tensioning panel in a hammock loading and unloading position.

FIG. 8 is a side view of the frame of FIG. 1 in a fully collapsed position.

FIG. 9 is a bottom view taken along line 9—9 of FIG. 1.

DETAILED DESCRIPTION OF THE PRESENTLY PREFERRED EMBODIMENTS

Figure 1:
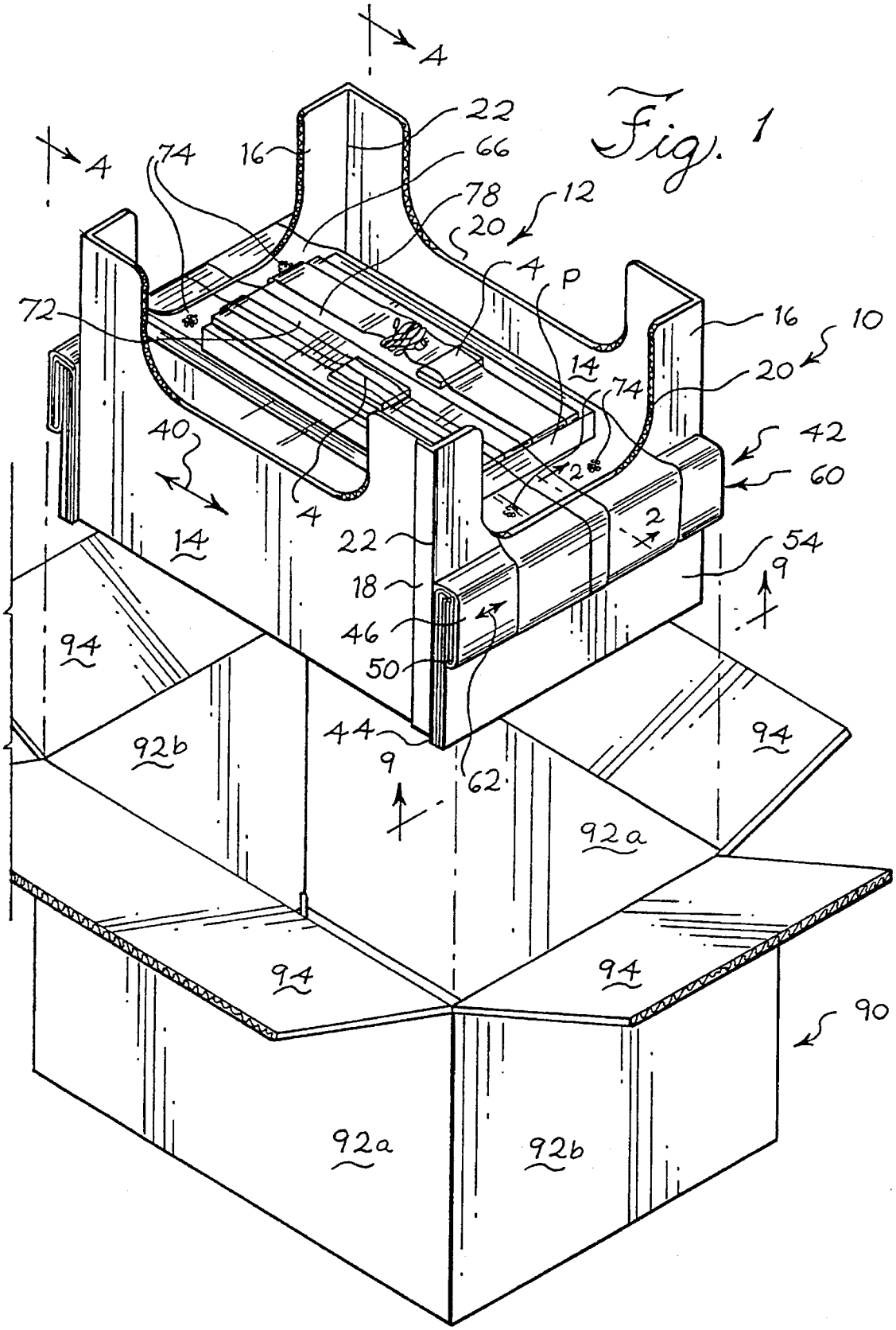
FIG. 1 is an exploded perspective view of a suspension package which incorporates a first embodiment of this invention.

Turning now to the drawings, FIG. 1 shows an exploded perspective view of a suspension package 10 which incorporates an embodiment of this invention. The suspension package 10 includes a frame 12 sized to fit within an outer box 90.

The frame 12 includes two parallel side walls 14 interconnected by two parallel end walls 16. In this embodiment the side walls 14 and the end walls 16 are formed from a single piece of corrugated material that is joined at an outside overlap 18. Optional cutouts 20 may be formed at the upper central portions of the walls 14, 16, and the junctions between the walls 14, 16 are defined by fold lines 22.

Figure 7:
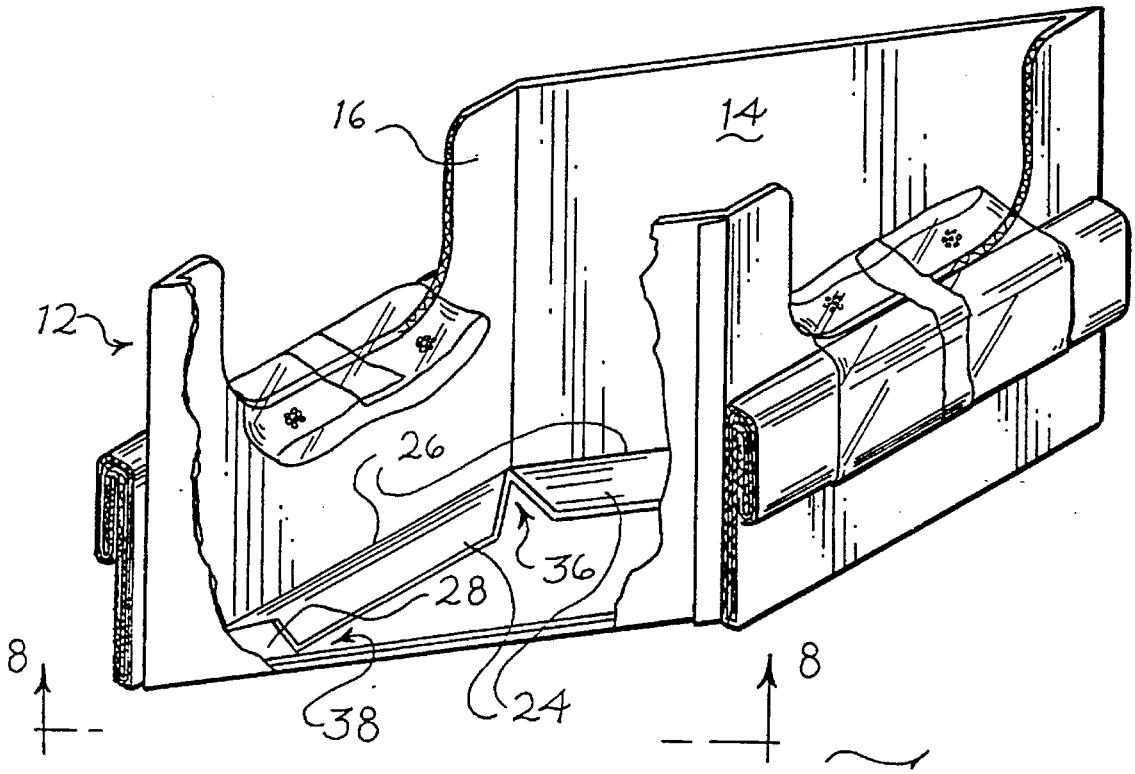
FIG. 7 is a perspective view in partial cutaway of the frame of FIG. 1 in a partially collapsed position.

As best shown in FIGS. 7–9, four bottom panels 24 are included in the frame 12. In this embodiment each of the bottom panels 24 is integral with a respective one of the walls 14, 16 and is connected thereto at a fold line 26 (FIG. 7). Each of the bottom panels 24 includes an integral bottom panel corner flap 28 at each end. These bottom panel corner flaps 28 are generally trapezoidal or triangular in shape and include an inner edge 30, an outer edge 32 and a free edge 34 (FIG. 8). In each case the bottom panel corner flap 28 is connected to the adjacent bottom panel 24 by a fold line at the inner edge 30. Adjacent bottom panels 24 are interconnected by a fold line at the adjacent outer edges 32. The free edges 34 face inwardly, away from the walls 14, 16.

As best shown in FIGS. 8 and 9, at least two diametrically positioned ones of the corners are first corners 36 which are expandable, i.e., movable to an unfolded position. The remaining two corners are second corners 38 which in this embodiment are not expandable. In this embodiment the expandable first corners 36 are arranged such that the bottom panel corner flaps 28 are free to fold toward and away from one another along the outer edges 32. The second corners 38 in contrast are secured together with the bottom panel corner flaps 28 in overlying relationship, as for example by means of a suitable adhesive.

The frame 12 can be moved between an operational position as shown in FIG. 1 and a storage position in which the side walls 14 approach one another for compact storage. FIGS. 7 and 8 are two views showing the frame 12 near and in the storage position, respectively. Note that the first corners 36 have expanded to allow the frame 12 to collapse. In use, the frame 12 is moved from the storage position of FIG. 8 to the operational position of FIG. 1. The second corners 38 ensure that the bottom panels 24 are automatically moved to a bracing position, in which the bottom panels 24 extend away from the walls 14, 16 at a perpendicular or an acute angle. In this way, the need for any separate assembly steps is eliminated. The bottom panels 24 reinforce the side walls 14 to prevent or reduce creasing or bowing of the side walls 14 when tension is applied to the hammock.

Preferably, the frame 12 is formed of a corrugated material. In order to enhance strength of the side walls 14 the flutes of the corrugated material are preferably oriented in the direction indicated by the reference numeral 40 (FIG. 1), such that the flutes extend along the side walls 14 from one end wall 16 to the other.

Of course, many changes and modifications can be made to the frame 12. For example, other materials can be used instead of the corrugated material discussed above, and the flute direction can be altered if desired. The second corners 38 can be secured together by any suitable means, such as adhesives and mechanical fasteners including staples. It is not essential in all embodiments that two of the corners be secured together. All of the corners can be left expandable if desired. This complicates assembly of the frame 12 into the operational position, to some extent.

Figure 2:
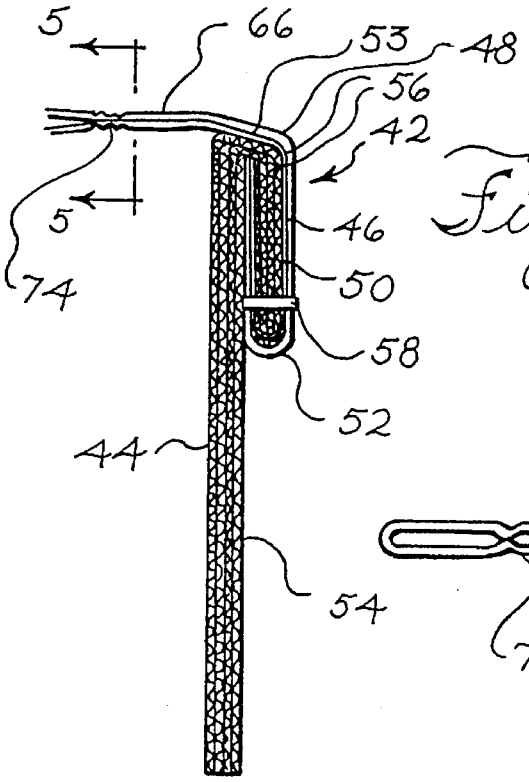
FIG. 2 is a partial sectional view taken along line 2—2 of FIG. 1, showing the tensioning panel in a hammock tensioning position.

As shown in FIGS. 1, 2 and 3, a tensioning panel 42 is mounted on each of the end walls 16. Each tensioning panel 42 in this embodiment is formed of a folded corrugated material. As shown in FIGS. 2 and 3, the tensioning panel 42 includes a first panel 44 connected to a second panel 46 by a bridging panel 53 that forms a first bend 48. Each panel also includes a third panel 50 connected to the second panel 46 by second bend 52. An extension 54 is secured to the third panel 50, and a hammock 66 is secured to the second and third panels 46, 50. The purpose of the extension 54 is to react against the outer container and hold the tensioning panel 42 in the hammock tensioning position. The extension 54 bears at its lower end on the outer container and at its upper end against the underside of the bridging panel 53, thereby bracing the bridging panel 53 against buckling.

In this embodiment adhesives 56 are used to secure the second and third panels 46, 50 together and to secure the extension 54 to the third panel 50. Staples 58 are used to secure the second and third panels 46, 50 together, and to secure the hammock 66 to the third panel 50.

FIG. 2 shows the tensioning panel 42 in the hammock tensioning position, in which the second and third panels 46, 50 have been pivoted in a clockwise direction as shown in FIG. 2 in the area of the first bend 48.

FIG. 3 shows the tensioning panel 42 in a product inserting and removing position in which tension on the hammock is relaxed. In this position the second and third panels 46, 50 have been pivoted counterclockwise in the region of the first bend 48 to reduce the distance between the ends of the hammock 66, and thereby relieve tension on the hammock 66.

As best shown in FIG. 1, the first, second and third panels 44, 46, 50 and the bridging panel 53 and extension 54 cooperate to form a stiff, elongated bridging element 60. The bridging element 60 is slightly longer than the width of the end wall 16 such that the bridging element 60 applies compressive loads at the corners of the frame 12 in alignment with the side walls 14. In this way, the bridging element 60 effectively transfers compressive loads from the hammock 66 to the side walls 14, and thereby reduces any tendency of the end wall 16 to fold or crease under load.

When the tensioning panel is in the hammock tensioning position of FIG. 2, the bridging panel 53 defines an acute angle with respect to the lower portion of the adjacent end wall 16. In this position the bridging panel is effectively braced to resist stress imposed by the hammock 66.

Figure 4:
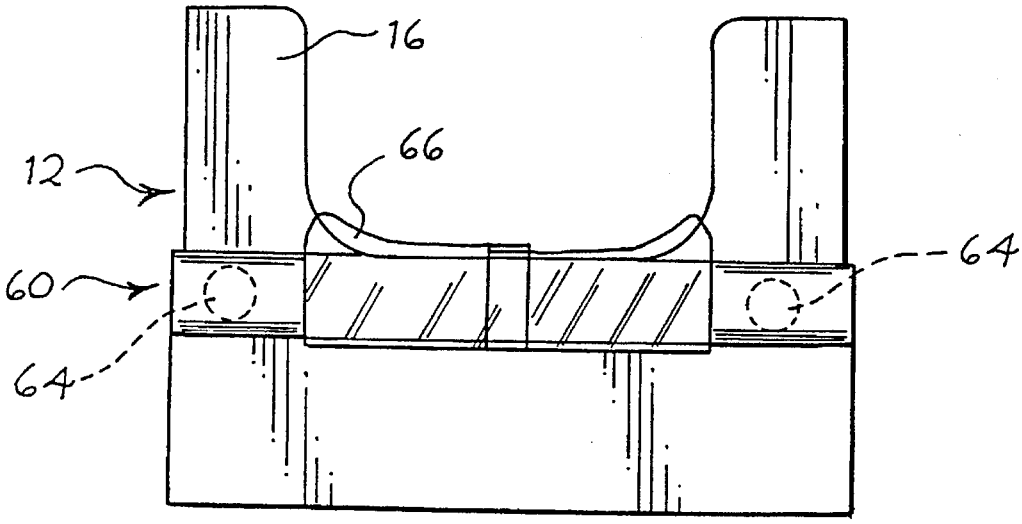
FIG. 4 is an end view taken along line 4—4 of FIG. 1.

In this preferred embodiment the first, second, and third panels 44, 46, 50 the bridging panel 53 and the extension 54 of the tensioning panel 42 are formed of a single piece of double wall corrugated material that is folded into the illustrated configuration. The flutes of this corrugated material are preferably arranged parallel to the arrow 62 so as to extend between the side walls 14. An adhesive 64 is preferably used to secure the first panel 44 to the end wall 16 (FIG. 4).

Of course, many changes can be made to the tensioning panel 42 as appropriate to the particular application. The tensioning panel 42 can be assembled from one or more pieces, and it can be formed integrally with or separately from the end wall as desired. The bridging element 60 can be formed of other materials including plastic and single-wall corrugated materials, and one or more of the panels of the tensioning panel can be eliminated if desired. Only a single tensioning panel 42 can be used, if desired. The extension 54 is not required in all embodiments. The flutes of a corrugated material can be oriented otherwise than as discussed above, and adhesives can be applied either before or after the hammock is attached.

Figure 5:
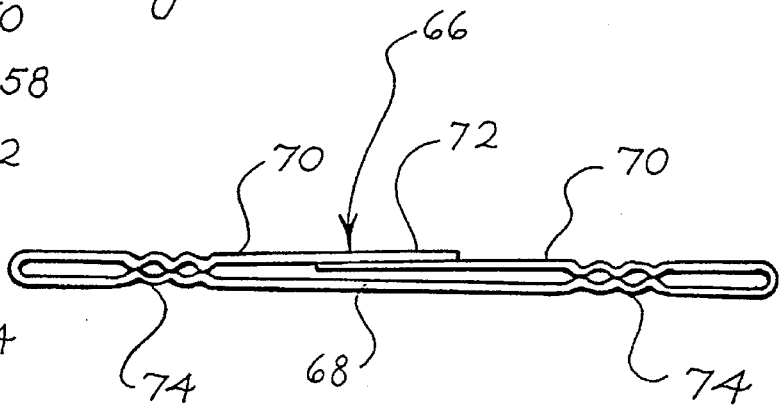
FIG. 5 is a cross-sectional view taken along line 5—5 of FIG. 2.

As shown in FIG. 5, the hammock 66 in this embodiment defines a C-shaped cross section, and it includes a lower portion 68 and two upper portions 70. The product inserting and removing region 72 is created between the two upper portions 70. Four product-retention regions 74 are provided, and the lower portion 68 is secured to the upper portion 70 in each of these product-retention regions. In this preferred embodiment this is accomplished by thermally welding the upper and lower portions 68, 70 together in the regions 74, as for example by sonic welding. The C-shaped cross section ensures that loads are distributed over a large portion of the bridging element 60. If desired, the hammock 66 can be formed of multiple pieces rather than one piece folded in a C-fold.

The product-retention regions 74 are positioned as appropriate for the size and shape of the product P being packaged and the degree of protection to be provided. Generally speaking, the product-retention regions 74 should be sufficiently far apart to allow the product P easily to be inserted into and removed from the hammock 66 via the region 72 when the tensioning panels 42 are pivoted upwardly. The product-retention regions 74 should be positioned to restrict the product P from sliding in the hammock 66 into contact with one of the end walls 16 when the hammock 66 is tensioned and the tensioning panels 42 are in the position shown in FIG. 2. Typically, the product-retention regions 74 are positioned near but spaced slightly from the outside edges of the hammock 66 to catch the product P on its corners. If the product-retention regions 74 are placed toward the center of the hammock 66, the difficulty of loading and unloading the product P is increased.

In this embodiment, the product-retention regions 74 are rounded in shape and have an area of about one square inch each. Welded dots or a knurled pattern formed with a sonic sealer have been found suitable. Of course, various types of fasteners can be used in the product-retention regions 74, including mechanical fasteners such as staples and chemical fasteners such as adhesives. The precise position of the product-retention regions 74 should be selected as appropriate for the particular product P being packaged.

Figure 6:
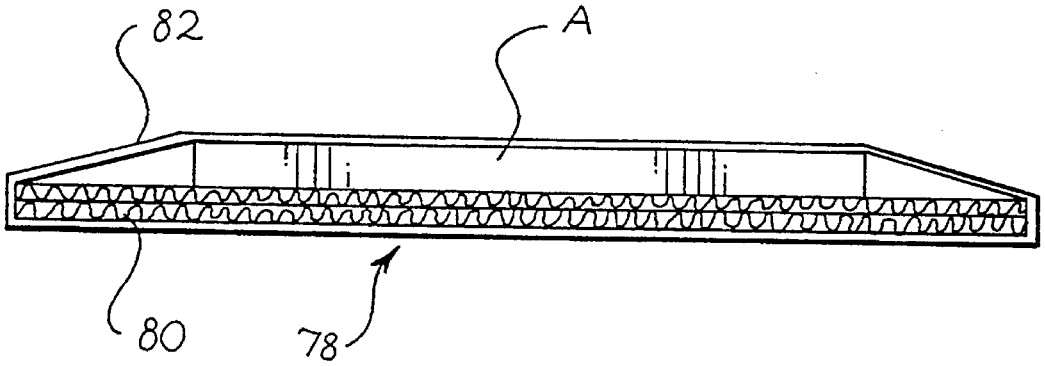
FIG. 6 is a side view of an accessory holder included in the embodiment of FIG. 1.

As best shown in FIGS. 1 and 6, an accessory holder 78 is provided for accessories A. This accessory holder 78 includes a pad 80, which can for example be formed of a corrugated material, and one or more stretchable, resilient bands 82 which can for example be formed of polyurethane. The band 82 preferably forms a complete loop around the pad 80 to eliminate scratching of the product P. Preferably, the pad 80 is substantially the same width as the hammock 86 to eliminate any lateral shifting of the pad 80 in the hammock 86. In use, the accessories A are loaded into the accessory holder 78 by positioning them between the pad 80 and the band 82. Then the accessory holder 78 is loaded into the hammock 66 at the same time that the product P is loaded. The band 82 prevents the accessories A from moving along the length of the hammock, and the hammock itself prevents lateral movement.

Many variations are possible. For example, the band 82 can extend only part way around the pad 80 if desired, and materials, sizes and shapes can all be modified as appropriate for the application. The arrangement for the hammock 66 described above provides the advantage of spreading loads on the bridging member 60 widely. However, it should be understood that other arrangements and other fold patterns for the hammock 66 are possible.

As pointed out above, materials can be selected as appropriate for the particular application. The following information regarding preferred materials applies only to certain applications, and is not intended to be limiting. By way of example, the frame 12 can be formed of a corrugated board such as 275 pound single wall, kraft, C-flute board. The tensioning panel 42 can be formed of a double wall corrugated board such as 275 or 350 pound double wall, kraft, B/C-flute board. The hammock 66 and the band 82 can be formed of a polyurethane film such as polyester-polyurethane film (JPS film no. 1495) in a thickness of 0.004–0.008 inches (preferably 0.006 inch) for the hammock 66 and 0.002–0.004 inch for the band 82.

In use the frame 12 is squared up to the operational position of FIG. 1 and the tensioning panels 42 are allowed to rise to the position of FIG. 3. Then the product P and the accessory holder 78 are inserted in the hammock 66 through the product inserting and removing region 72. The tensioning panels 42 are then pivoted downwardly to the position shown in FIG. 2 and the frame 12 is inserted in an outer box 90, which may for example be a conventional corrugated outer box 90 having side walls **92*a*, end walls 92*b*, and top flaps 94. The outer box 90 is dimensioned such that the frame 12 and the tensioning panels 46 are restricted from moving in the outer box 90. The end walls 92*b* of the outer box 90 restrain the tensioning panels 42 from returning to the position of FIG. 3. As explained above, the product-retention regions 74 restrict the product P from sliding toward the end walls 16, and the accessory holder 78 assists in immobilizing the accessories A in the hammock 66. The box 90** is preferably collapsible, and the lower panels can be releasably locked in place, as for example with an Arthur lock.

Turning now to FIGS. 10 through 16, these figures represent a second embodiment of this invention, which includes a suspension package 110 and an outer box 190.

Figure 14:
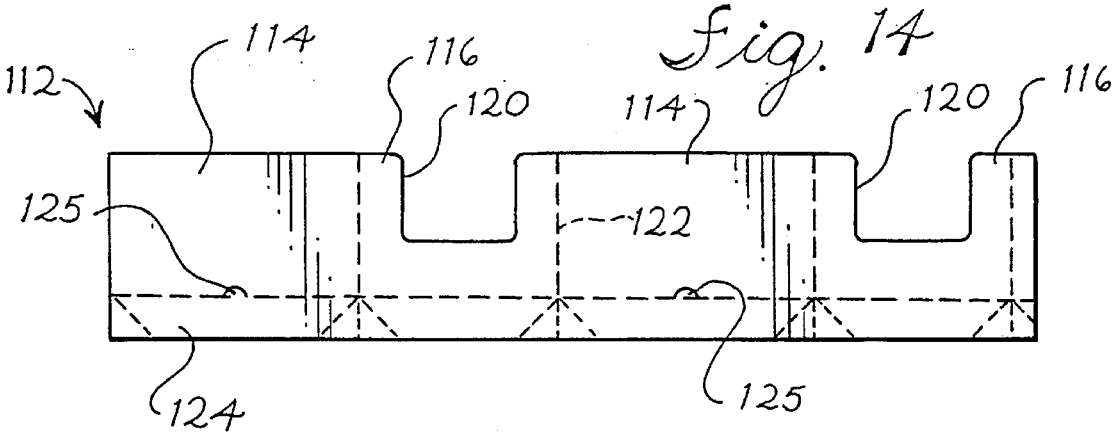
FIG. 14 is a plan view of a corrugated paperboard blank suitable for forming the suspension package frame of FIG. 10.

The suspension package 110 includes a rectangular frame 112 which includes two side walls 114 and two end walls 116. A cut-out 120 is preferably formed in each end wall 116, and adjacent walls are separated by fold lines 122. FIG. 14 is a plan view of a corrugated paperboard blank suitable for forming the frame 112. As shown in FIG. 14, the frame 112 includes bottom panels 124 which can be folded to the configuration discussed above in conjunction with the first preferred embodiment. However, in this embodiment all four of the corners are preferably left in an expandable form such that the frame 112 is free to collapse along either diagonal.

Additionally, the suspension package 110 includes two finger-pull notches 125, each centered on a respective one of the side walls 114. These finger-pull notches 125 can be used in removing the suspension package 110 from the outer box 190, as described below.

Figure 10:
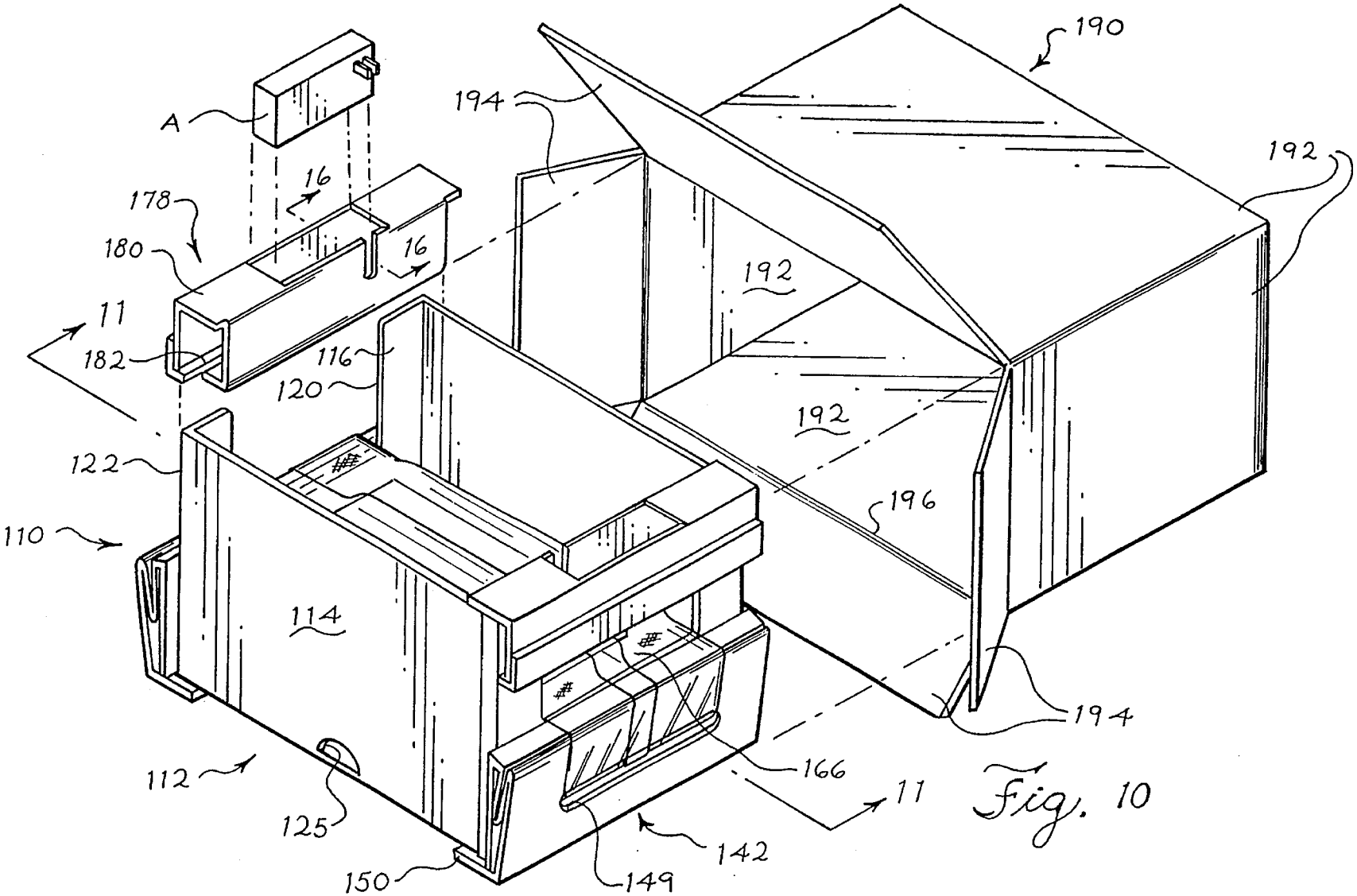
FIG. 10 is an exploded perspective view of a suspension package which incorporates a second embodiment of this invention.
Figures 11, 12, 16:
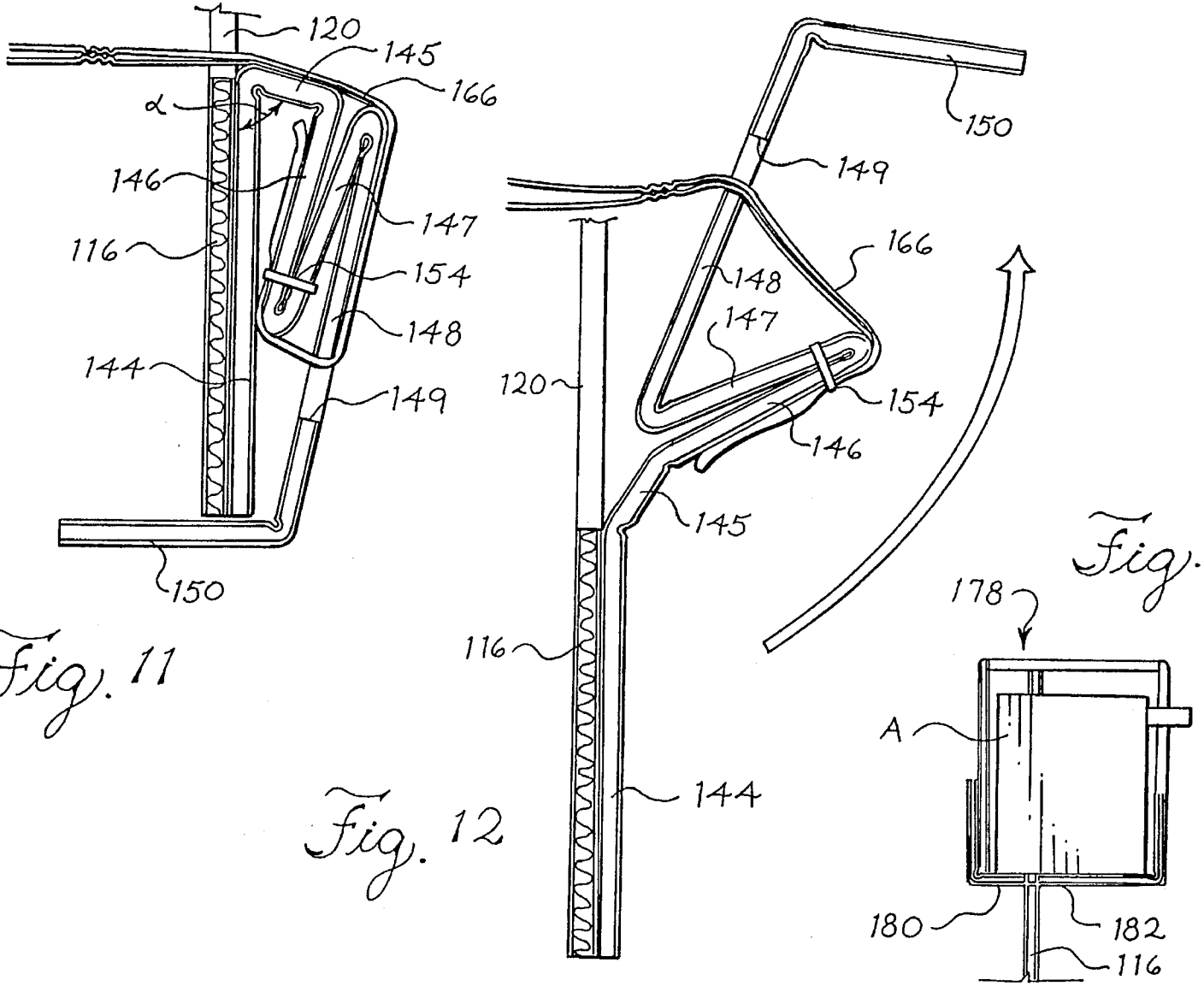
FIG. 11 is a cross-sectional view taken along line 11—11 of FIG. 10, showing the tensioning flap in a hammock tensioning position.
FIG. 12 is a view corresponding to FIG. 11 showing the tensioning panel in a hammock releasing position.
FIG. 16 is a cross-sectional view taken along line 16—16 of FIG. 10.
Figure 13:
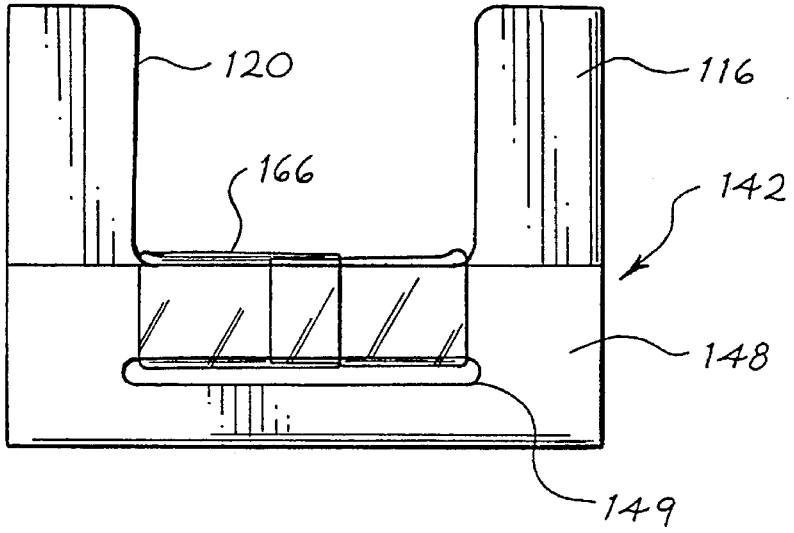
FIG. 13 is an end view of the suspension package of FIG. 10.
Figure 15:
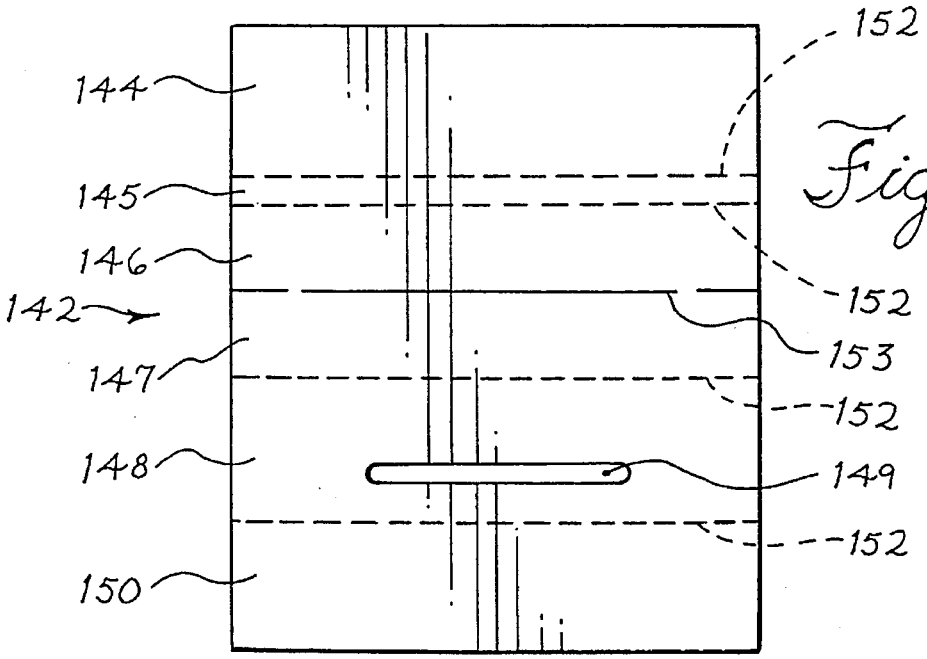
FIG. 15 is a plan view of a corrugated paperboard blank suitable for forming the tensioning panel of FIG. 10.

As best shown in FIGS. 10, 12 and 15, the suspension package 110 includes a pair of tensioning panels 142. Each of the tensioning panels 142 in this embodiment is preferably folded from a single sheet of a suitable corrugated paperboard, as shown for example in FIG. 15. The tensioning panel 142 includes six adjacent panels interconnected by respective fold lines 152. The innermost of these panels is an inner panel 144 which is secured, as for example by a suitable adhesive, to an adjacent one of the end walls 116. The inner panel 144 secures the entire tensioning panel 142 in place on the frame 112. The inner panel 144 is connected to a bridging panel 145, which is in turn connected to a first intermediate panel 146. The first intermediate panel is connected to a second intermediate panel 147, which is in turn connected to an outer panel 148. The outer panel 148 defines an elongated slot 149, and the distal end of the outer panel 149 is connected to an extension panel 150. The fold line between the two intermediate panels 146, 147 is preferably formed as a partial slit 153.

FIGS. 11 and 12 show the manner in which the hammock 166 (which may be identical to the hammock 66 discussed above) is secured to the tensioning panel 142. An end portion of the hammock 166 passes through the slot 149 and is secured to one of the intermediate panels 146, 147, by one or more staples 154. Preferably, the staples 154 secure only the intermediate panels 146, 147 together and to the hammock 166, and none of the staples 154 passes through the outer panel 148. This arrangement has been found to minimize the concentration of stresses on the outer panel 148, and to reduce any tendency of the outer panel 148 to buckle when the hammock 166 is subjected to extreme loads.

As best shown in FIG. 11, when the tensioning panel 142 is in the hammock tensioning position the bridging panel 145 defines an acute angle $\alpha$ with respect to the lower portion of the adjacent end wall 116. When the bridging panel 145 is so positioned, it is effectively braced to resist stress imposed by the hammock 166. Preferably, the tensioning panel 142 is formed of a corrugated paperboard material, and the flutes are arranged to run vertically, parallel to the side walls 114, in order to provide maximum resistance against undesired creasing or deformation of the bridging element 145 as a result of tension on the hammock 166.

FIG. 11 shows the tensioning panel 142 in a hammock tensioning position. In this arrangement the various panels of the tensioning panel 142 are arranged in an M-fold, and the extension panel 150 extends under the end wall 116, in a plane perpendicular to that of the end wall 116. FIG. 12 shows the tensioning panel 142 in a hammock releasing position, in which tension has been substantially released from the hammock 166. The extension panel 150 reduces any tendency of the tensioning panel 142 to rotate from the hammock tensioning position of FIG. 11 to the hammock releasing position of FIG. 12 while the suspension package 110 is confined within the outer box 190.

As shown in FIG. 10, the outer box 190 includes five fixed side walls 192 and one side opening 196. The side opening 196 can be opened and closed as desired by openable flaps 194.

In this embodiment the side opening 196 is shaped to correspond in size and shape to one of the walls of the suspension package 110. In particular, in this embodiment the side opening 196 corresponds to one of the side walls 114. In use, an article to be shipped is inserted into the hammock 166, and then the tensioning panels 142 are moved to the hammock tensioning position shown in FIG. 10. The extension panels 150 are positioned as shown in FIG. 10 perpendicular to the end walls 116, underneath the suspension package frame 112. Then the suspension package 110 is moved along a direction perpendicular to one of the side walls 114 through the side opening 196 into the outer box 190. Once the suspension package 110 is in place, the openable flaps 194 can be closed to seal the outer box 190.

When it is desired to unpack the suspension package 110 from the outer box 190, the finger-pull notch 125 can be grasped by user to pull the suspension package 110 out of the outer box 190. This side loading feature has been found to simplify loading of the suspension package 110 into the outer box 190, and to reduce any tendency for the tensioning panels 142 to spring outwardly during the loading operation. Of course, in an alternate arrangement the side opening 196 can be dimensioned to receive one of the end walls 116.

Turning now to FIGS. 10 and 16, the suspension package 110 may include one or more accessory holders 178. Each accessory holder 178 comprises a tube 180 which may, for example, be formed from a folded blank of a suitable corrugated paperboard. The tube 180 can either be open at its ends or closed. If open, it is the outer box 190 that restrains objects within the accessory holder 178 from moving out of the ends. The accessory holder 178 includes a pair of slots 182, each sized to receive a respective portion of one of the end walls 116. Thus, the slots 182 cooperate with the end wall 116 to hold the accessory holder 178 in position. The outer box 190 holds the accessory holder 178 in engagement with the end wall 116, and the outer box 190 restrains objects within the accessory holder 178 from moving out the ends of the tube 180. FIGS. 10 and 16 show an accessory A mounted in the accessory holder 178. As illustrated, the accessory holder may be provided with openings, slots, or the like to engage protruding elements of the accessory A to prevent the accessory A from shifting in the tube 180.

Figure 17:
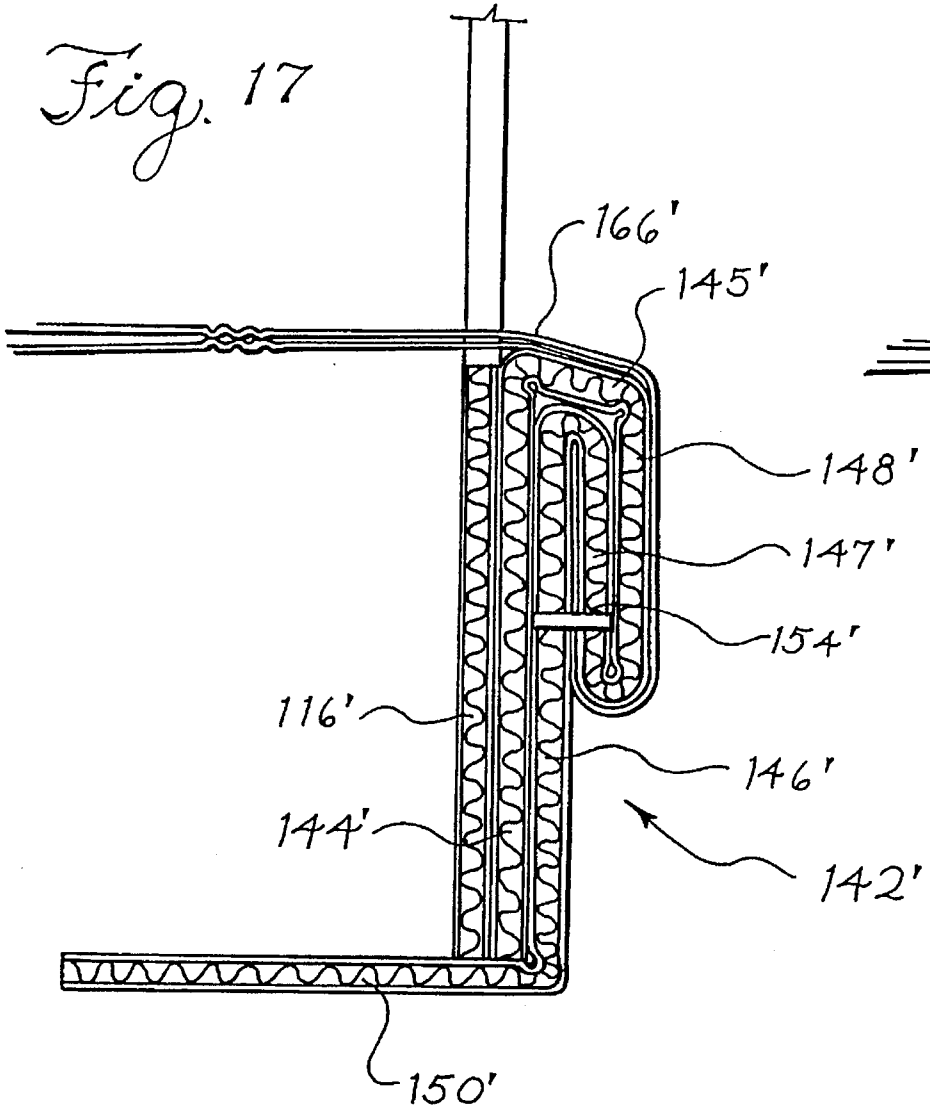
FIG. 17 is a cross-sectional view corresponding to that of FIG. 11 of a third preferred embodiment of this invention.

FIG. 17 shows a tensioning panel 142' of a third embodiment of this invention. The tensioning panel 142' can be used in the suspension package 110 and the outer box 190 described above. As shown in FIG. 17, the tensioning panel 142' includes an inner panel 144' which is adhesively secured to the adjacent end wall 116'. This inner panel 144' is connected at a fold line to a bridging panel 145' which is, in turn, connected at a fold line to an outer panel 148'. The outer panel 148' is connected at a single-score fold line to a first intermediate panel 147', which is, in turn, connected to a second intermediate panel 146'. The second intermediate panel 146' is connected at a fold line to an extension panel 150'.

Figure 18:
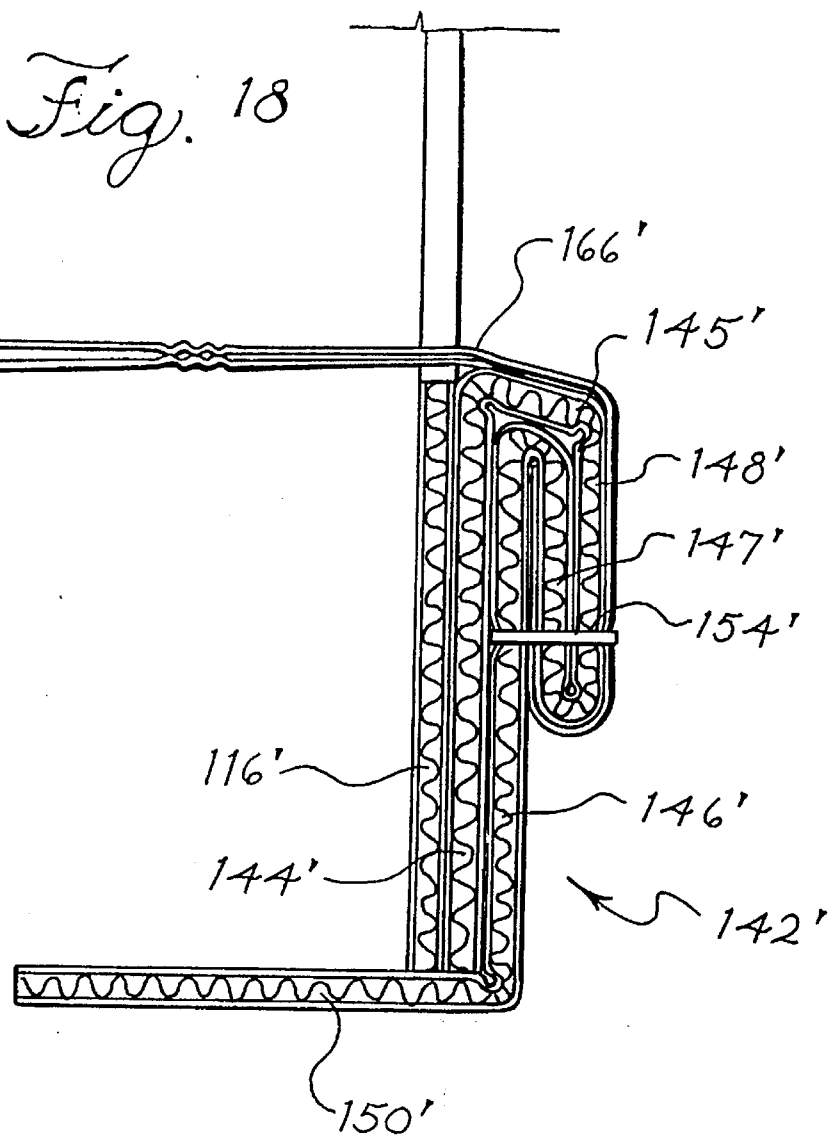
FIG. 18 is a cross-sectional view of a modified form of the embodiment of FIG. 17.

The tensioning panel 142' is shown in the hammock tensioning position in FIG. 17. In this position the hammock 166' extends alongside the bridging panel 145' and the outer panel 148', into the region between the first and second intermediate panels 147', 146'. One or more staples 154' secure the end of the hammock 166' in place. In the embodiment of FIG. 17, none of these staples 154' extends through the outer panel 148', thereby eliminating undesirable stress concentrations. Alternately, the staples can extend through the outer panel 148', as shown in FIG. 18.

When the tensioning panel 142' is in the hammock tensioning position of FIG. 17, the bridging panel 145' defines an acute angle with respect to the adjacent inner panel 144', providing the advantages discussed above. In addition, tension on the hammock 166' tends to drive at least one of the first and second intermediate panels 147', 146' against the underside of the bridging panel 145', thereby further bracing the bridging panel 145' against buckling. The extension panel 150' functions in the same way as the extension panel 150 discussed above.

It should be noted that the tensioning panels 142, 142' all have a sufficient width so as to extend completely across the adjacent end wall 116, 116' and thereby to channel a substantial part of compressive forces directly to the side walls 114, 114'. In this way the tensioning panels 142, 142' act as bridging elements to shelter the end walls 116, 116' from distorting forces, and any tendency of the end wall 116, 116' to buckle under hammock tension is substantially reduced or eliminated.

Simply by way of example, the following information is provided in order further to define the best mode of the invention as presently contemplated by the inventors. This information is of course intended to be by way of illustration, and is not intended to limit the scope of the following claims in any way. The tensioning panels 42, 142, 142' can be secured in place to the adjacent end wall 16, 116, 116' with a hot-melt glue such as that distributed by Fuller as glue no. HM-1828. The staples 58, 154, 154' can be staples of the type used in an IDEAL stitcher. The product-retention region 74 can be formed with a sonic sealer such as that manufactured by Dukane.

From the foregoing it should be apparent that an improved suspension package has been described which retains the important advantage that the frame 12 is collapsible when not in use. This improved suspension package can use low-cost corrugated materials, and it provides the important advantages that any tendency of the end walls to crease or fail in use is reduced and any tendency of the product to slip in the hammock axially is reduced as well. These advantages are achieved while facilitating loading and assembly of the frame. Because the bridging element 60 is formed separately from the frame in this embodiment, the amount of material required to fabricate a suspension package 10 is reduced.

Of course, many changes and modifications can be made to the preferred embodiments discussed above. For example, if desired a notch can be formed in the first panel 44 and the lower portion of the end wall 16. These notches can be aligned with an assembly fixture to simplify the assembly of the tensioning panel 42 in the proper position on the end wall 16. As mentioned above, the various aspects of this invention can be used separately if desired, and there is no requirement that the various aspects of this invention must be used together as described above. For example, all four corners of the frame 12 can be formed such that the frame is prevented from collapsing to a storage position.

It is therefore intended that the foregoing detailed description be regarded as illustrative rather than limiting, and that it be understood that is the following claims, including all equivalents, which are intended to define the scope of this invention.

We claim:

1. In a suspension package comprising a frame comprising two side walls interconnected by two end walls, a tensioning panel pivotably mounted to one of the end walls, and a product-retaining hammock mounted to the frame to suspend a product in the frame between the end walls, said hammock secured to the tensioning panel such that pivotal movement of the tensioning panel in a selected direction applies tension to the hammock, the improvement comprising:

four bottom panels, each secured to a respective one of the walls, said bottom panels contacting one another at four corners of the frame when the frame is in an operational position;

at least two diametrically opposed first ones of said corners being expandable to allow the frame to collapse to a storage position in which the side walls approach one another and the hammock.

2. The invention of claim 1 wherein the bottom panels are secured together at two diametrically opposed second ones of said corners such that the bottom panels automatically move to a wall bracing position when the frame is moved from the storage to an operational position.

3. The invention of claim 2 wherein each bottom panel is integral with and connected by a respective fold line to the respective wall.

4. The invention of claim 3 wherein each bottom panel comprises a respective bottom panel corner flap at each end, wherein the bottom panel corner flaps are secured together in overlapping relationship at the second ones of the corners.

5. The invention of claim 4 wherein the bottom panel corner flaps comprise inner edges connected to the respective panels at respective fold lines and outer edges, and wherein the bottom panel corner flaps are secured together only at the outer edges at the first ones of the corners.

6. The invention of claim 1 wherein the frame comprises a corrugated material, said material comprising flutes which in the side walls extend between the end walls.

7. In a suspension package comprising a frame comprising two side walls interconnected by two end walls, a tensioning panel pivotably mounted to one of the end walls, and a product-retaining hammock mounted to the frame to suspend a product in the frame between the end walls, said hammock secured to the tensioning panel such that pivotal movement of the tensioning panel in a selected direction applies tension to the hammock, the improvement comprising:

a bridging element included in the tensioning panel, said bridging element having a length sufficient to extend across the end wall such that the bridging element defines two ends, each end extending to intersect a respective plane, each plane aligned with a respective said side wall, said bridging element positioned to receive forces from the hammock and to transfer compressive loads to the side walls.

8. The invention of claim 7 wherein the bridging element comprises a corrugated material, said material comprising flutes which extend between the side walls.

9. The invention of claim 7 wherein the tensioning panel is adhesively secured to the respective end wall.

10. The invention of claim 7 wherein the end wall has a width measured between the side walls, and wherein the length of the bridging element is greater than the width of the end wall such that the bridging element extends past the side walls.

11. The invention of claim 7 wherein the bridging element comprises first, second, and third bridging panels, said first and second bridging panels secured together at a first bend, said second and third bridging panels secured together at a second bend, said first bridging panel secured to the end wall, said hammock positioned to extend over the second bend and to lie alongside the third bridging panel, said first, second, and third bridging panels all having a length sufficient to extend across the end wall.

12. The invention of claim 7 wherein the bridging element comprises a bridging panel having a length sufficient to extend substantially completely across the end wall, said bridging panel oriented adjacent to and extending outwardly from the end wall and positioned to support the hammock when the hammock is tensioned.

13. The invention of claim 12 wherein the tensioning panel pivots toward a lower portion of the end wall to tension the hammock, wherein the bridging panel defines an acute angle with the lower portion of the end wall when the hammock is tensioned, and wherein the tensioning panel comprises an extension panel dimensioned to brace the bridging panel from below.

14. The invention of claim 7 wherein the tensioning panel comprises at least inner, outer, and first and second intermediate panels, said inner panel secured to the end wall, said first intermediate panel secured to the hammock, said second intermediate panel folded alongside the first intermediate panel, and said outer panel forming a slot, said hammock overlying a portion of the outer panel, passing through the slot, and secured to at least one of the intermediate panels.

15. The invention of claim 14 wherein the outer panel is free of fasteners securing the fourth panel to the hammock.

16. The invention of claim 14 wherein the tensioning panel further comprises a bridging panel positioned between the inner and first intermediate panels, said bridging panel extending outwardly from the end wall and positioned to support the hammock when the hammock is tensioned.

17. The invention of claim 16 wherein the tensioning panel pivots toward a lower portion of the end wall to tension the hammock, and wherein the bridging panel defines an acute angle with the lower portion of the end wall when the hammock is tensioned.

18. The invention of claim 7 wherein the tensioning panel further comprises an extension panel dimensioned to extend under the frame, transverse to the end wall, when the hammock is tensioned.

19. The invention of claim 12, wherein the tensioning panel further comprises an outer panel secured to the bridging panel, a first intermediate panel secured to the outer panel, and a second intermediate panel secured to the first intermediate panel to lie alongside the first intermediate panel;

said hammock secured in place to the tensioning panel between the first and second intermediate panels and supported by the bridging panel and the outer panel when the hammock is tensioned.

20. The invention of claim 19 wherein adjacent ones of the panels are secured together at respective fold lines.

21. The invention of claim 19 wherein the hammock, when tensioned, biases at least one of the intermediate panels into contact with the bridging panel.

22. The invention of claim 19 wherein the tensioning panel further-comprises an extension panel dimensioned to extend under the frame, transverse to the end wall, when the hammock is tensioned.

23. The invention of claim 19 wherein the outer panel is free of fasteners securing the hammock to the outer panel.

24. The invention of claim 7 wherein the bridging element comprises corrugated board, wherein the corrugated board comprises flutes, and wherein the flutes are oriented parallel to at least one of the side walls of the frame.

25. In a suspension package comprising a frame comprising two side walls interconnected by two end walls, a tensioning panel pivotably mounted to one of the end walls, and a product-retaining hammock mounted to the frame to suspend a product in the frame between the end walls, said hammock secured to the tensioning panel such that pivotal movement of the tensioning panel in a selected direction applies tension to the hammock, the improvement comprising:

said hammock comprising a lower portion and at least two upper portions, said upper portions defining a product inserting and removing region therebetween such that a product may be inserted into the hammock from above through the product inserting and removing region;

said upper and lower portions comprising product-retention regions between the product inserting and removing region and the end walls, said upper and lower portions secured together at the product-retention regions to hold a product retained in the hammock away from the end walls.

26. The invention of claim 25 wherein the upper and lower portions are secured together at the product-retention regions by welds.

27. The invention of claim 26 wherein the welds are grouped in at least one field, and wherein the field is rounded in shape.

28. The invention of claim 25 wherein the upper and lower portions define a C-shaped configuration.

29. In a suspension package comprising a frame comprising two side walls interconnected by two end walls, a tensioning panel pivotably mounted to one of the end walls, and a product-retaining hammock mounted to the frame to suspend a product in the frame between the end walls, said hammock secured to the tensioning panel such that pivotal movement of the tensioning panel in a selected direction applies tension to the hammock, the improvement comprising:

an accessory holder held in place on at least one of the walls of the frame, said accessory holder comprising a tube which comprises at least one slot, each slot receiving said at least one wall to hold the tube on the frame.

30. The invention of claim 29 wherein the tube is open-ended.

31. The invention of claim 29 wherein the at least one wall comprises one of the end walls, and wherein the tube extends between the side walls.

32. In a suspension package comprising a frame comprising two side walls interconnected by two end walls, a tensioning panel pivotably mounted to one of the end walls, and a product-retaining hammock mounted to the frame to suspend a product in the frame between the end walls, said hammock secured to the tensioning panel such that pivotal movement of the tensioning panel in a selected direction applies tension to the hammock, the improvement comprising:

a frame-enclosing outer box, said box comprising a plurality of fixed panels and at least one openable flap, said at least one openable flap opening and closing a side of the box, said side corresponding in shape to a first one of the end and side walls of the frame such that the frame is moved into and out of the box along an axis of movement perpendicular to said first wall, said box dimensioned to hold the tensioning panel in a hammock-tensioning position.

33. The invention of claim 32 wherein said first wall is a side wall.

34. The invention of claim 32 wherein said first wall comprises a finger pull notch shaped to assist a user in pulling the frame from the box.

35. The invention of claim 32 wherein said first profile is a side profile.

36. In a package comprising a frame comprising two side walls, a tensioning panel pivotably mounted to the frame, and a product-retaining hammock mounted to the frame to hold a product in the frame between the side walls, said hammock secured to the tensioning panel such that pivotal movement of the tensioning panel in a selected direction applies tension to the hammock, said frame forming a side profile and an end profile, the improvement comprising:

a frame-enclosing outer box, said box comprising a plurality of fixed panels and at least one openable flap, said at least one openable flap opening and closing a side of the box, said side corresponding in shape to a first one of the side and end profiles of the frame such that the frame is moved into and out of the box along an axis of movement perpendicular to said first profile, said box dimensioned to hold the tensioning panel in a hammock-tensioning position.

* * * * *